US008320595B2

(12) United States Patent
Tschirpke

(10) Patent No.: US 8,320,595 B2
(45) Date of Patent: Nov. 27, 2012

(54) WIRELESS ACOUSTIC SPEAKER MOUNT

(76) Inventor: David C. Tschirpke, N. Grosvenordale, CT (US)

( * ) Notice: Subject to any disclaimer, the term of this patent is extended or adjusted under 35 U.S.C. 154(b) by 1151 days.

(21) Appl. No.: 11/981,874

(22) Filed: Oct. 31, 2007

(65) Prior Publication Data

US 2009/0110216 A1 Apr. 30, 2009

(51) Int. Cl.
*H04R 9/06* (2006.01)
*H04R 1/02* (2006.01)

(52) U.S. Cl. ..... 381/334; 381/345; 381/386; 381/390

(58) Field of Classification Search ..... 381/394, 381/120, 334, 87, 361, 386, 390, 335, 336, 381/395

See application file for complete search history.

(56) References Cited

U.S. PATENT DOCUMENTS

| | | | | |
|---|---|---|---|---|
| 6,195,572 | B1 * | 2/2001 | Patterson et al. | 455/570 |
| 2004/0022401 | A1 * | 2/2004 | Watanabe et al. | 381/109 |
| 2004/0244046 | A1 * | 12/2004 | Champion | 725/112 |
| 2006/0187364 | A1 * | 8/2006 | Fukano | 348/836 |
| 2006/0188118 | A1 * | 8/2006 | Berger et al. | 381/315 |
| 2007/0147641 | A1 * | 6/2007 | Platz | 381/315 |
| 2007/0223723 | A1 * | 9/2007 | Haase | 381/77 |
| 2007/0286432 | A1 * | 12/2007 | Shin et al. | 381/77 |
| 2008/0152160 | A1 * | 6/2008 | Chew et al. | 381/71.6 |

OTHER PUBLICATIONS http://www.eoswireless.com/eos_wireless_home_audio_base.html (Downloaded Sep. 14, 2007) Eos Base Station Transmitter The Eos base station transmitter broadcasts interference-free CD quality audio throughout your home, inside and out—up to 150 feet to up to 4 wireless speakers.

* cited by examiner

*Primary Examiner* — Mohamad Musleh
*Assistant Examiner* — Mangtin Lian
(74) *Attorney, Agent, or Firm* — Mirick, O'Connell, DeMallie + Lougee, LLP

(57) ABSTRACT

A Wireless Acoustic SPeaker mount, or WASP, is disclosed that serves as both a wireless speaker adapter and a speaker mount. Some embodiments include a separate transmitter that obtains wired acoustic signals from an acoustic source and transmits them wirelessly to the WASP. WASP's can include a digital and/or analog wireless receiver, digital-to-analog converter, amplifier, and/or equalizer or other sound quality adjuster. WASP's can rest on a horizontal surface or be mounted to or embedded within a wall, ceiling, or other structure. Speakers can rest on or attach to a WASP or be mounted inside of a WASP. In various embodiments the horizontal and/or vertical positioning of the speaker is adjustable, WASP's can be used outdoors, WASP's can extend a wireless transmission range by relaying signals to other WASP's, and the transmitter and WASP's can send on/off and other command signals to each other.

19 Claims, 16 Drawing Sheets

WIRELESS ACOUSTIC SPEAKER MOUNT

FIELD OF THE INVENTION

The invention generally relates to audio speaker systems, and more specifically to apparatus for mounting audio speakers and adapting them for wireless use.

BACKGROUND OF THE INVENTION

When installing audio speakers, it is not always convenient or even possible to use conventional wires to connect them to the intended audio source, which may be a stereo, a television, a computer, an iPod, or any other device that supplies an audio signal to a speaker. In such cases, wireless speakers are often used in place of conventional wired speakers.

A wireless speaker system includes at least one transmitter, at least one receiving unit, and at least one audio speaker. The at least one transmitter obtains audio signals from an audio source, typically through a wired connection, and broadcasts them to one or more receiving units in either digital or analog format using radio waves, microwaves, infra-red light, or other wireless means. In some cases, the transmitter is an integral part of the audio source, so that a separate transmitter is not needed. The receiving units convert the wireless signals from the transmitter into an appropriate format and supply them to one or more acoustic speakers, typically through wired connections. Typically, a receiving unit and at least one acoustic speaker are housed together as a so-called "wireless speaker," and in some cases a mounting means is included to facilitate mounting of the wireless speaker to a wall, ceiling, or other convenient support surface.

In cases where a wireless speaker solution is indicated but it is nevertheless desirable to use existing conventional wired speakers, for example in a case where high quality and costly wired speakers are already available, a wireless speaker adapter system can be used. A wireless speaker adapter system is essentially a wireless speaker system as described above, except that audio speakers are not included. Instead, each receiving unit includes appropriate connection means to allow wired connection to at least one conventional speaker. This approach allows the use of conventional wired speakers in a wireless speaker configuration, but it does not provide any means for mounting the speakers, for example to a wall, ceiling, or other convenient support surface.

Another disadvantage of existing wireless speaker solutions is the limited range over which they can operate. Due to both practical and legal restrictions, the range over which signals can be received from a wireless acoustic signal transmitter often prevents the application of existing wireless speaker solutions to larger environments such as large homes, office buildings, and the like.

SUMMARY OF THE INVENTION

In one aspect of the invention, an apparatus is disclosed, herein referred to as a Wireless Acoustic SPeaker mount, or WASP, that combines a receiver capable of receiving wireless acoustic signals with mounting or supporting means for at least one wired acoustic speaker. In embodiments where the wireless acoustic signals are not directly compatible with the intended acoustic speaker, a converter is also included that transforms the output of the receiver into a format appropriate for driving the acoustic speaker. For example, in preferred embodiments the converter transforms the signal from digital to analog format and/or adjusts the voltage, output current, and output impedance of the signal so as to be compatible with the intended audio speaker. In some preferred embodiments, the WASP includes at least one acoustic signal adjuster that can balance and adjust the quality of the sound produced by the at least one wired acoustic speaker.

In preferred embodiments where the audio source does not include the capability of transmitting wireless acoustic signals, a transmitter is also included that can obtain audio signals from the audio source by wired means and transmit them to one or more WASP units by wireless means such as RF, microwave, infra-red light, or other wireless transmissions. In various preferred embodiments, the wireless audio signals are digital, and in some of these embodiments they include digital addresses that correspond to specific WASP units, thereby allowing WASP units to reject wireless signals not intended for them.

In some preferred embodiments, at least one acoustic speaker is mounted to the exterior of the WASP. In other preferred embodiments, an acoustic speaker is mounted within the WASP together with the receiver and any other elements. In yet other preferred embodiments, the WASP unit provides a shelf or other surface upon which one or more acoustic speakers can be placed, and in still further preferred embodiments the top of the WASP housing itself serves as a platform that can support at least one acoustic speaker. Preferred embodiments also include means for adjusting the horizontal and/or vertical positioning of an acoustic speaker relative to the WASP, so as to place the acoustic speaker in an optimal location.

In some preferred embodiments, WASP units include installation means for attaching the WASP to a wall, ceiling, or other surface, or for installing the WASP inside of a wall, floor, ceiling, or other structural surface. In some of these preferred embodiments an acoustic speaker is mounted to the exterior of the WASP such that the housing of the acoustic speaker is approximately flush with the surface within which the WASP is installed. In some other of these preferred embodiments an acoustic speaker is mounted within the WASP, such that when the WASP is mounted within a wall or other structural surface the sound emitting face of the acoustic speaker is approximately flush with the surrounding surface.

In various preferred embodiments WASP units include the capability to receive and respond to wireless control signals instructing them for example to turn on or off, while in other preferred embodiments WASP units include the ability to originate and transmit signals to the main audio source or wireless transmitter, instructing it for example to turn on and off. In still other preferred embodiments, some WASP units includes a transmission means for relaying wireless signals to other WASP units, thereby expanding the range over which WASP units can be installed relative to the audio source. In another aspect of the invention, a wireless acoustic speaker apparatus is disclosed that includes a receiver that is able to receive wireless acoustic signals, a means for communicating the acoustic signals from the receiver to an acoustic speaker, and a transmitter that is able to re-transmit wireless acoustic signals received by the receiver, thereby extending the range over which the wireless acoustic signals can be received.

In various preferred embodiments, the transmitter is either physically cooperative with the receiver, or it is not physically cooperative with the receiver. Also, in some preferred embodiments the apparatus further includes an acoustic speaker and all additional components and means necessary to convert wireless acoustic signals received by the receiver into a format compatible with the acoustic speaker, and to communicate the converted acoustic signals to the acoustic speaker for audible output.

BRIEF DESCRIPTION OF THE DRAWINGS

in FIG. 3A a WASP is installed inside of a wall, and an acoustic speaker is mounted to the housing of the WASP by a bracket;

in FIG. 3B a WASP is installed inside of a ceiling, and an acoustic speaker is mounted to the housing of the WASP by a bracket;

in FIG. 3C a WASP is installed inside of a wall, and an acoustic speaker is mounted inside of the WASP such that the sound-emitting face of the speaker is approximately flush with the surface of the wall;

in FIG. 3D a WASP is installed inside of a ceiling, and an acoustic speaker is mounted inside of the WASP such that the sound-emitting face of the speaker is approximately flush with the surface of the ceiling;

in FIG. 3E, a WASP is installed by attachment to the surface of a wall, and an acoustic speaker is mounted inside of the WASP;

in FIG. 3F, a WASP is installed by attachment to the surface of a ceiling, and an acoustic speaker is mounted inside of the WASP;

in FIG. 3G, a WASP is installed by attachment to the surface of a wall, and an acoustic speaker is mounted by placement on a shelf attached to the WASP and projecting horizontally outward from the wall;

in FIG. 3H, a WASP rests on a floor, and an acoustic speaker is mounted by placement on top of the WASP;

in FIG. 3I, a WASP rests on a floor, and an acoustic speaker is mounted by placement on top of a variable-height pedestal mounted to the top of the WASP; and in FIG. 3J a WASP rests on a floor, and an acoustic speaker is mounted inside of the WASP.

DETAILED DESCRIPTION OF PREFERRED EMBODIMENTS

Figure 1A:
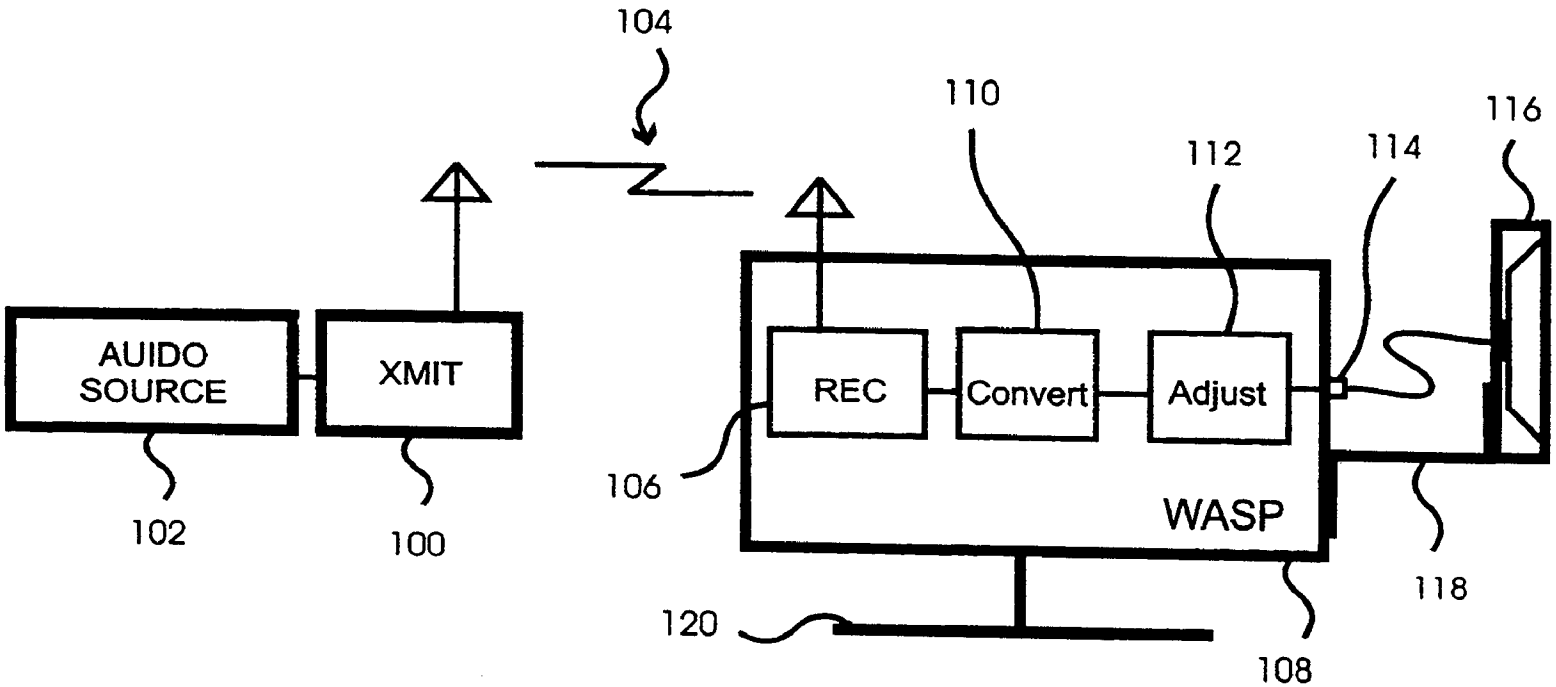
FIG. 1A presents a block diagram of a complete WASP wireless speaker system, including an audio source, a wireless transmitter, a receiver, a converter, an adjuster, and a wired speaker.

With reference to FIG. 1A, the invention disclosed herein is a Wireless Acoustic SPeaker mount, or WASP. As part of its function, the WASP serves as a wireless speaker adapter. A wireless transmitter 100 accepts audio signals from an audio source 102 and transmits them as wireless signals 104 to a receiver 106 contained within the WASP 108. In preferred embodiments a converter 110 in the WASP 108 transforms the audio signals to a required format. For example, depending on the embodiment, the converter 110 transforms the signals 104 from digital to analog format and/or adjusts the output voltage, current driving capability, and impedance to appropriate values. In FIG. 1A, all of these functions are represented as being contained in the converter. However, in some preferred embodiments several units are required. For example, in some embodiments the converter transforms the signal from digital to analog, and a separate amplifier unit (not shown) adjusts the output voltage, current driving capability, and impedance to appropriate values.

In some preferred embodiments, the audio signal is further adjusted 112 so as to optimize it for the specific placement and acoustic surroundings of the WASP 108. For example, in some preferred embodiments a so-called "equalizer" function is applied that adjusts the relative intensities of sounds falling within different frequency ranges. In the embodiment of FIG. 1A, the output of the WASP 108 is a connector 114 that allows connection to a wired acoustic speaker 116 by conventional wired means.

In some preferred embodiments, the receiver 106 is able to receive wireless commands from the transmitter 100 that cause some or all of the components in the WASP 108 to turn on or off, or to otherwise adjust their functioning. In other preferred embodiments, the WASP 108 includes means for direct user input (not shown) such as a button, dial, or other control, and is able to transmit commands to the transmitter 100 causing it to turn on or off, or otherwise to adjust its functioning.

In addition to functioning as a wireless speaker adaptor, the WASP 108 also serves as a speaker mount. In the embodiment of FIG. 1A, a bracket 118 is used to attach the wired speaker 116 to the WASP 108, and a stand 120 mounted beneath the WASP 108 is used to support the WASP 108 above the floor.

Figure 1B:
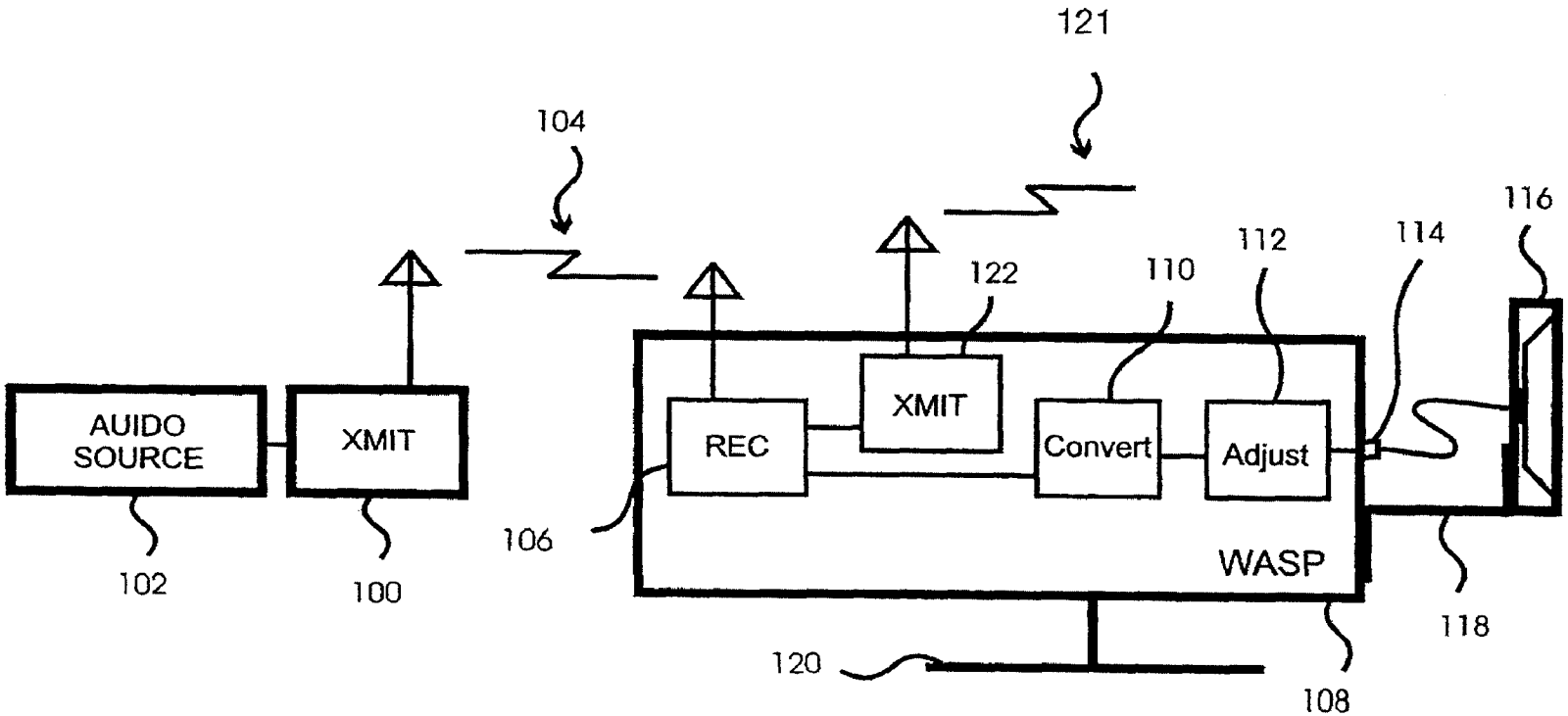
FIG. 1B presents a block diagram of a complete WASP wireless speaker system similar to the system of FIG. 1A, but also including a wireless signal relay transmitter in the WASP unit.

With reference to FIG. 1B, in preferred embodiments a WASP can also function as a wireless range extender. Wireless signals 104 received by the receiver 106 are retransmitting 121 by a transmitter 122 included in the WASP 108 to other WASP units that would otherwise would be too far from the transmitting source to receive the signals.

Figure 1C:
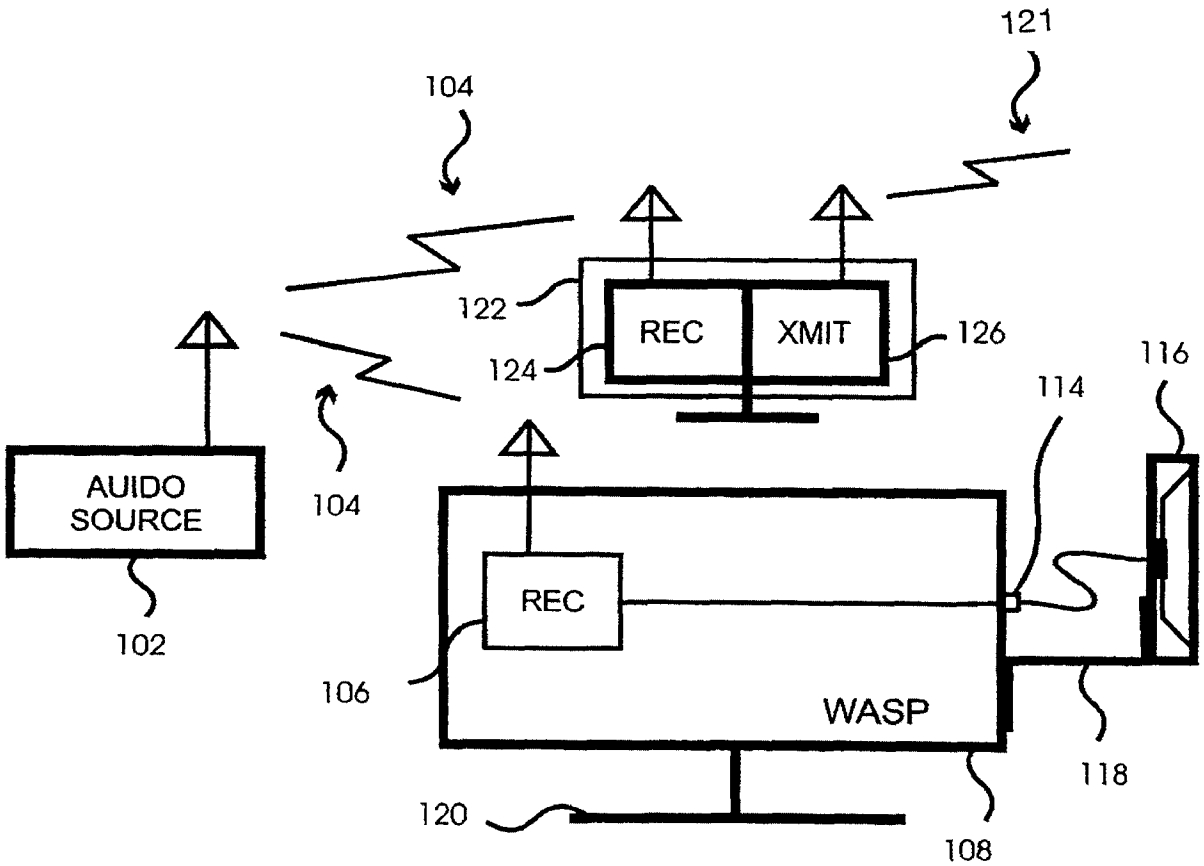
FIG. 1C presents a block diagram of a complete WASP wireless speaker system, including an audio source with included wireless transmitting capability, a receiver, and a wired speaker compatible with digital acoustic signals, and also including a wireless signal relay unit physically separate from the WASP unit.

With reference to FIG. 1C, in some preferred embodiments the audio source 102 includes a wireless transmitting means, so that a separate transmitter (100 in FIG. 1A and FIG. 1B) is not required. In other preferred embodiments, the wireless acoustic signals 104, once received, are directly compatible with the acoustic speaker, so that the converter (110 in FIG. 1A and FIG. 1B) and adjuster (112 in FIG. 1A and FIG. 1B) are not required. In still further preferred embodiments, the range over which the wireless acoustic signals can be received can be extended by a separate wireless relay unit 122 that includes its own wireless receiver 124 and transmitter 126.

Figure 2A:
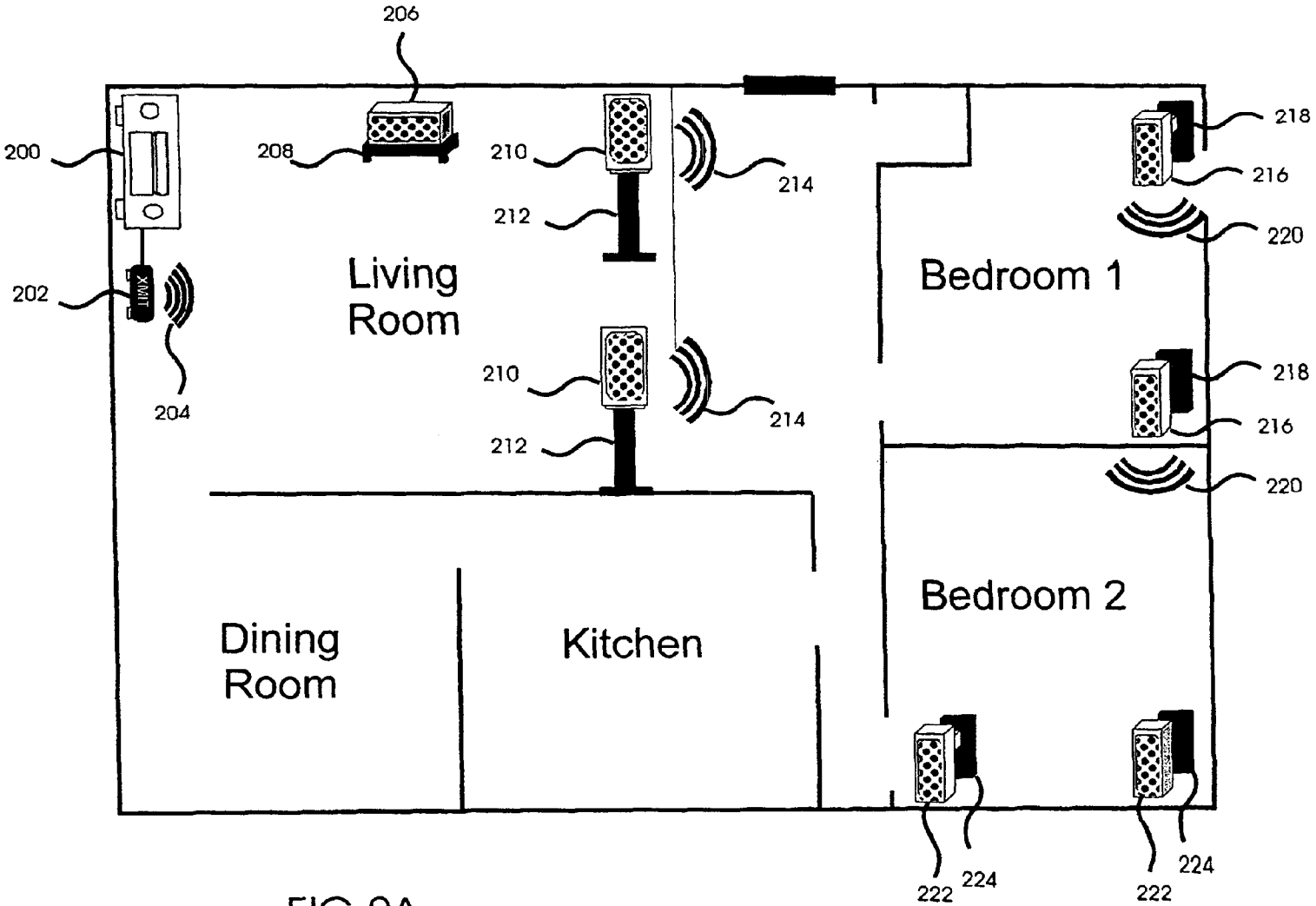
FIG. 2A shows a hypothetical floor plan of a home in which a plurality of WASP units relay signals from an audio source to acoustic speakers mounted in several widely separated rooms.

FIG. 2A presents a hypothetical floor plan of a home in which a plurality of WASP units relay signals from an audio source 200 to acoustic speakers mounted in several widely separated rooms. In FIG. 2A, a transmitter 202 in the living room receives acoustic signals by wired means from the audio source 200 and transmits them as wireless acoustic signals 204 to a WASP 206 mounted on a low platform 208 in the center of the living room, and to two WASP units 210 mounted on pedestals 212 at the far end of the living room. Throughout this embodiment and in similar preferred embodiments, the wireless acoustic signals 204 are digital and include digital addressing information that allows each WASP unit to accept only signals encoded with the digital address that matches the address assigned to that WASP unit. This allows, for example, a "surround sound" effect to be created by transmitting slightly different signals to the WASP unit 208 in the center of the room and to the two WASP units 210 mounted at the far end of the room.

The pedestal mounted WASP units 210 retransmit the wireless acoustic signals 214 to two additional WASP units 216 suspended by wall mounts 218 to the walls of a first bedroom. The wall mounted WASP units 216 retransmit the wireless acoustic signals 220 to yet two more WASP units 222 suspended by wall mounts 224 to the walls of a second bedroom. In this manner, the acoustic signals from the audio source 200 are distributed to speakers throughout the house without need of wires between the rooms and without requiring that all of the speakers be located within the transmission range of the wireless transmitter 202 attached to the audio source 200.

Figure 2B:
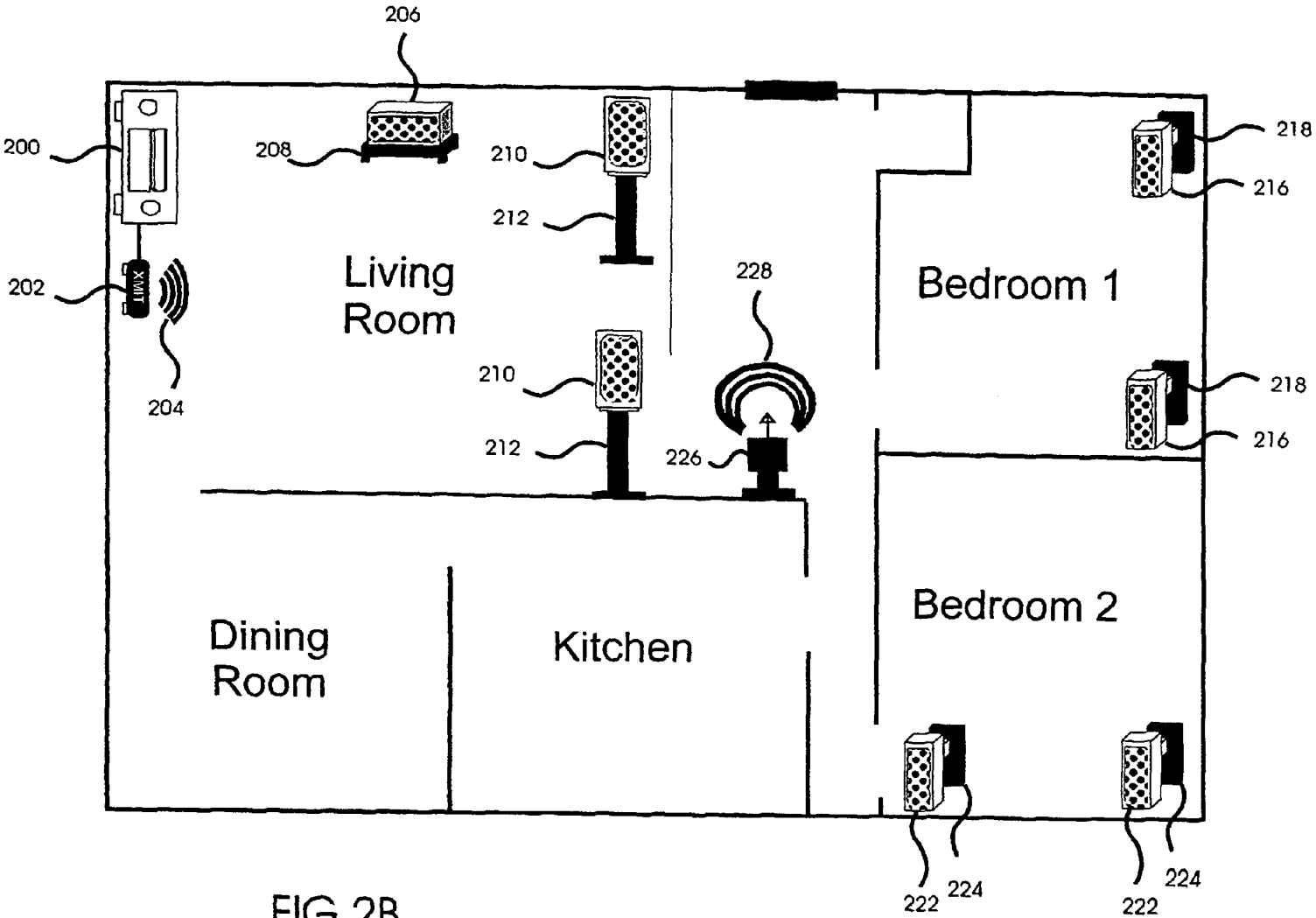
FIG. 2B shows a hypothetical floor plan of a home in which a physically separate wireless signal relay unit relays signals from an audio source to acoustic speakers mounted in several widely separated rooms.

FIG. 2B presents a floor plan similar to that of FIG. 2A, except that a separate wireless relay unit 226 is used to relay wireless signals 228 to WASP units 216, 222, that are located too far from the transmitter 202 to receive the signals 204 directly.

In general, a WASP unit includes means for supporting at least one acoustic speaker and means for installing the WASP unit at a location. In various embodiments, an acoustic speaker can be supported by attaching it to the exterior of a WASP, resting it on a shelf mounted to the WASP, resting it on top of the WASP, or mounting it inside of the WASP. In various embodiments, a WASP can be installed by attaching it to a wall, ceiling, or other supporting surface, installing it inside of a wall, a ceiling, or other supporting surface, or resting it on a floor or other horizontal surface. FIG. 3A through FIG. 3J illustrate preferred embodiments that use different combinations of these mounting and installing means.

Figure 3A:
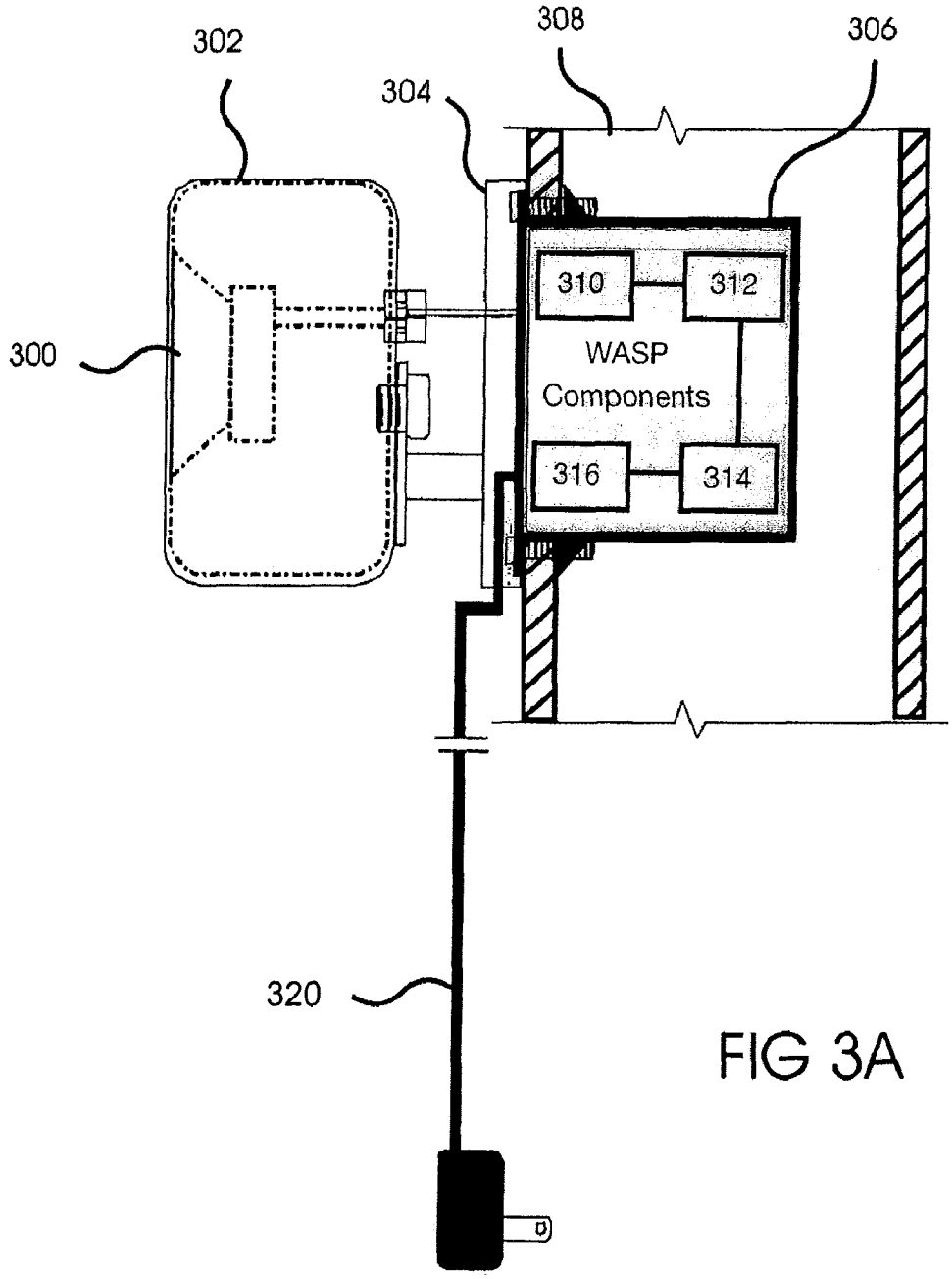
FIG. 3A through FIG. 3J show a variety of WASP configurations that use various means for mounting an acoustic speaker and installing a WASP unit.

In FIG. 3A, an acoustic speaker 300 is mounted within a housing 302 that is attached to a bracket 304. The bracket 304 is attached to a WASP 306 embedded inside of a wall 308. The bracket 304 is attached to a supporting surface 308, which in FIG. 3A is a wall, and supports both the speaker housing 302 and the WASP 306. Wireless acoustic signals are detected by a receiver 310 inside of the WASP 306, and pass through a converter 312, an amplifier 314 and an adjuster 316, all of which are contained within the WASP 306, before being connected to the acoustic speaker 300 by wired means. The WASP 306 also contains a power supply 318 that supplies power to units inside of the WASP 306 derived from AC power obtained through a power cord 320.

Figure 3B:
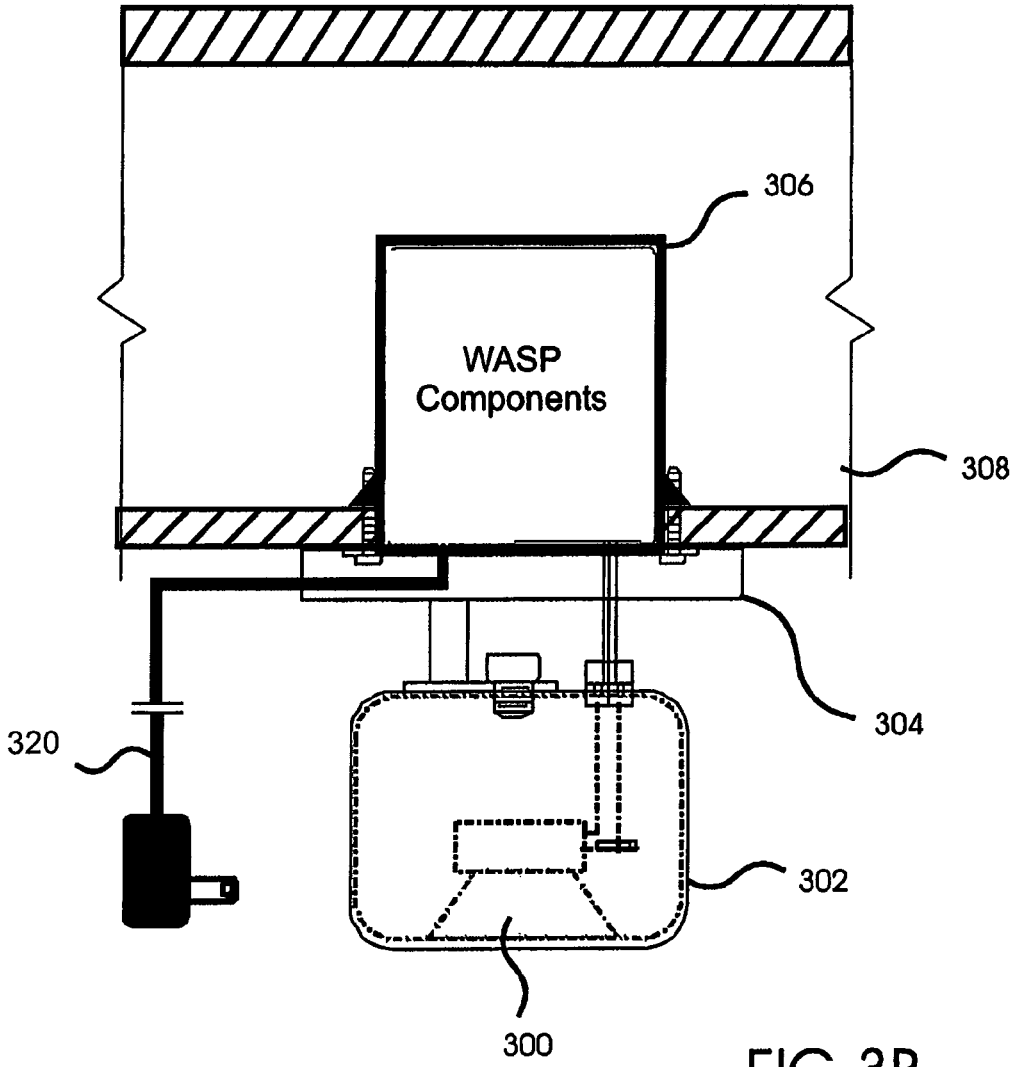

The embodiment of FIG. 3B is essentially identical to FIG. 3A, except that the supporting surface 308 is a ceiling instead of a wall.

Figure 3C:
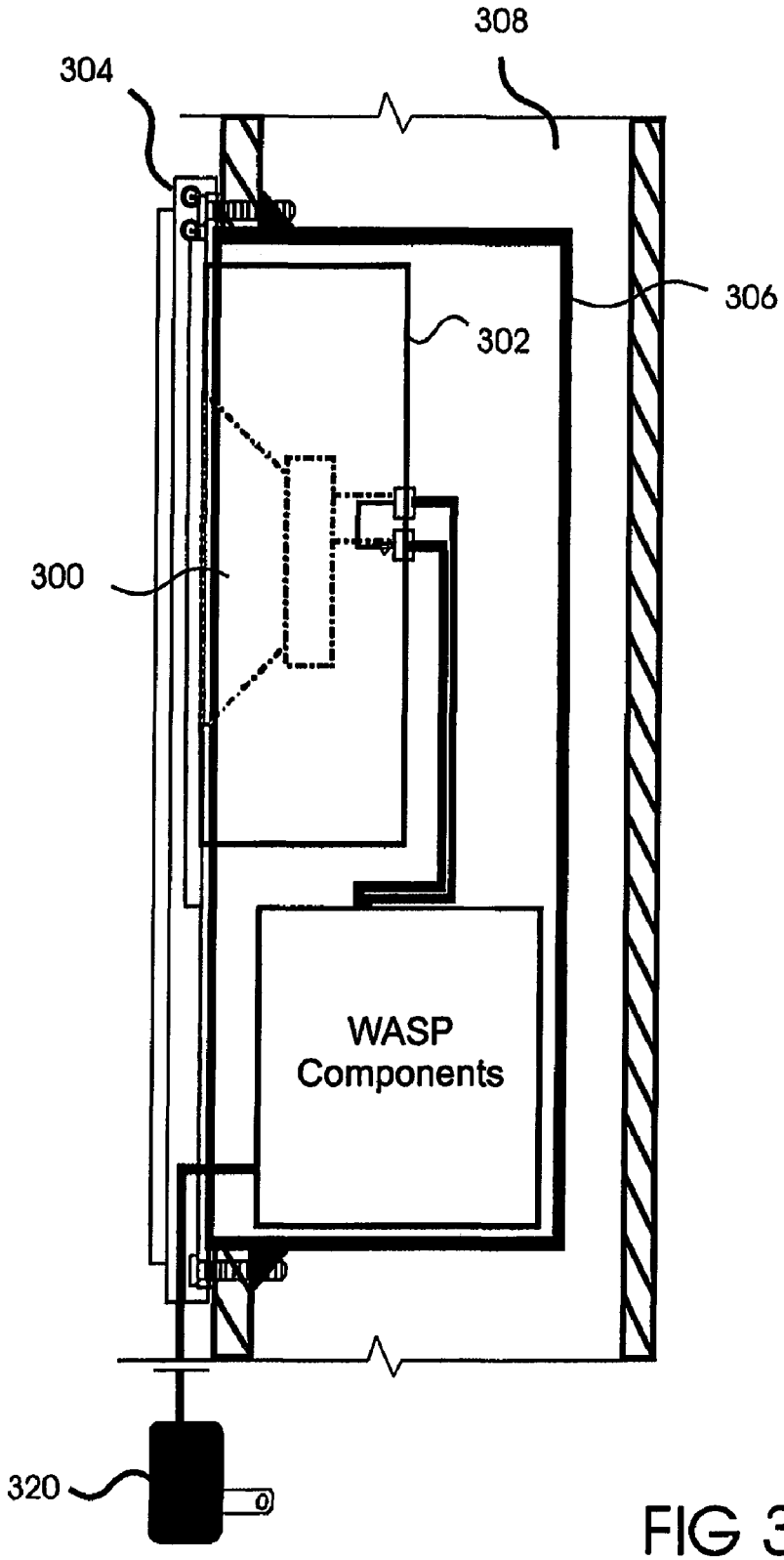

In FIG. 3C, the acoustic speaker 300 and speaker housing 302 are mounted inside of the WASP 306 in a manner that places the sound emitting face of the acoustic speaker 300 approximately even with the surface of the wall 308 when the WASP 306 is installed inside of the wall 308.

Figure 3D:
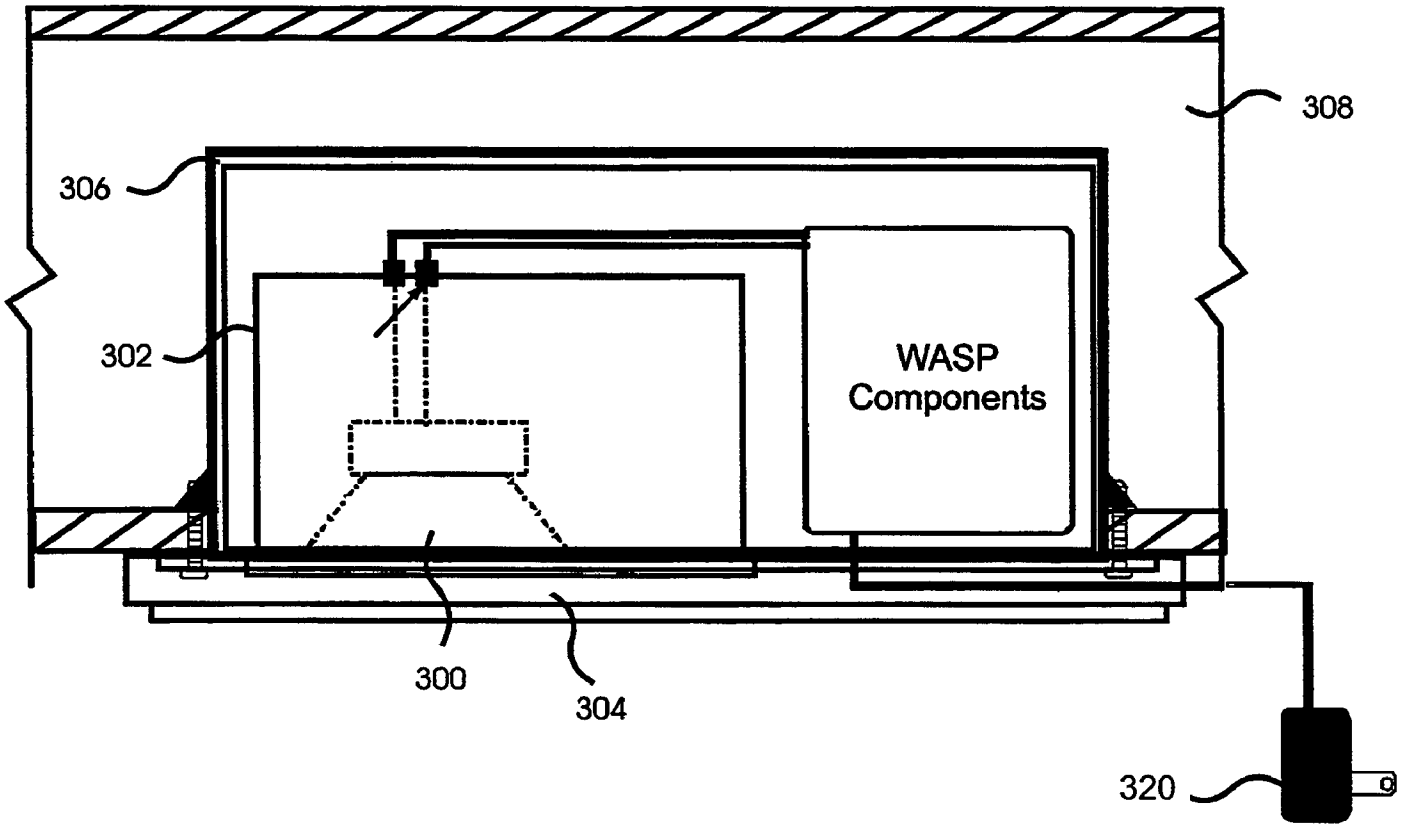

The embodiment of FIG. 3D is essentially identical to FIG. 3C, except that the supporting surface 308 is a ceiling instead of a wall.

Figure 3E:
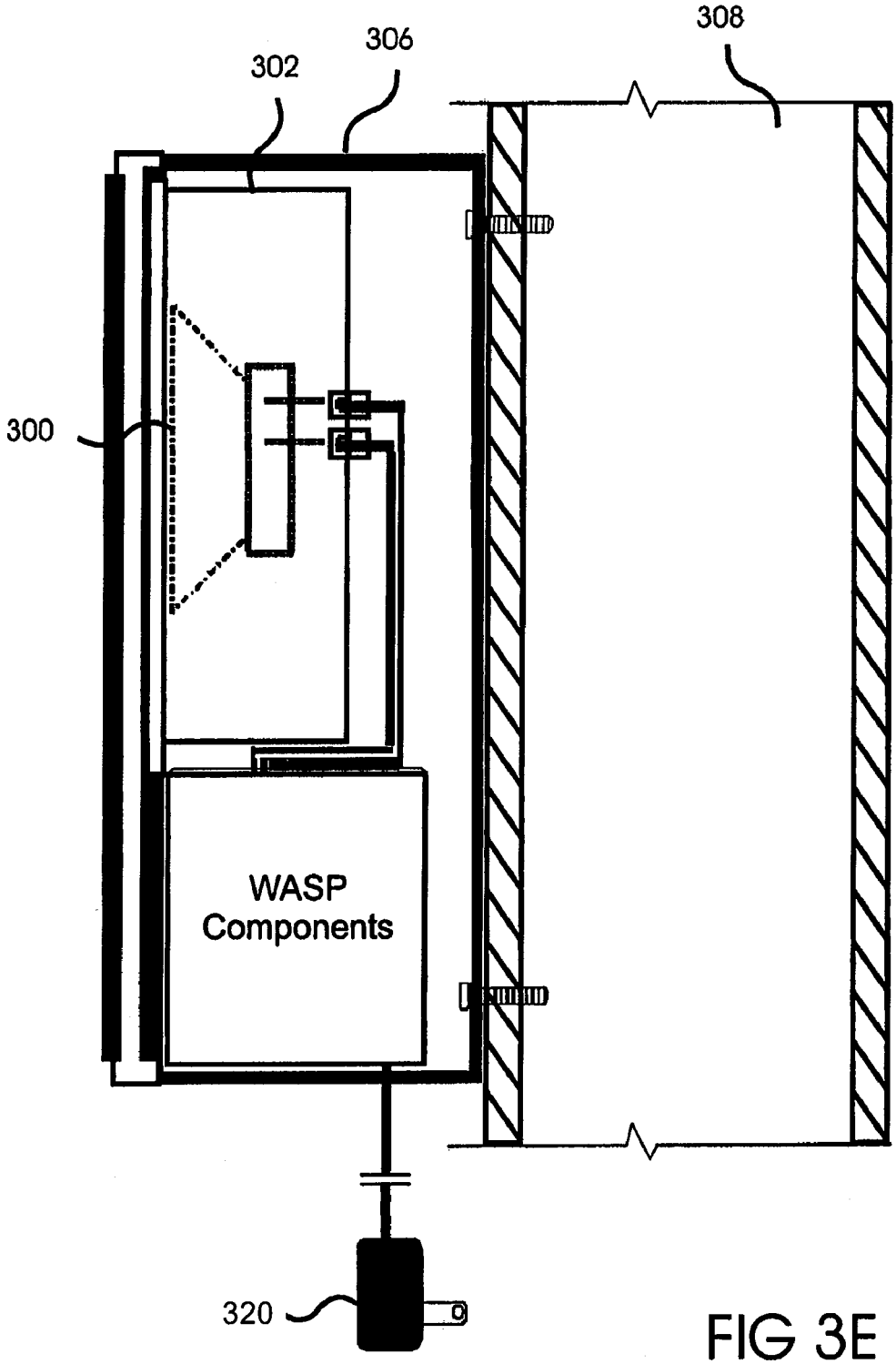

In FIG. 3E, the housing of the WASP 306 consists of an open, box-like structure with a removable cover 322. An acoustic speaker 300 is mounted to the removable cover 322 and thereby resides inside of the housing of the WASP 306 when the cover is attached. The rear of the WASP housing 306 is attachable by screws to a supporting surface 308, which in FIG. 3E is a wall.

Figure 3F:
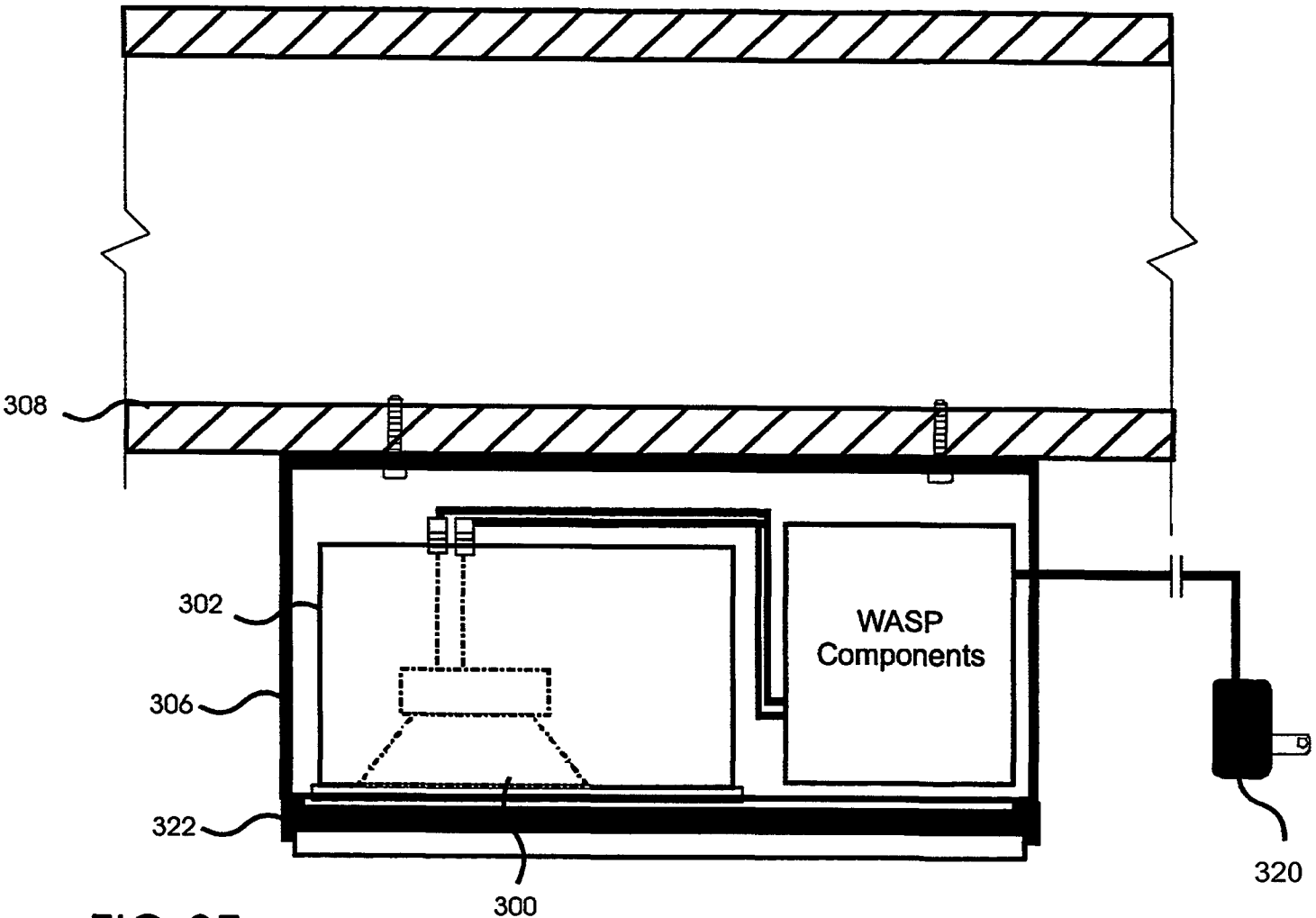

The embodiment of FIG. 3F is essentially identical to FIG. 3E, except that the supporting surface 308 is a ceiling instead of a wall.

Figure 3G:
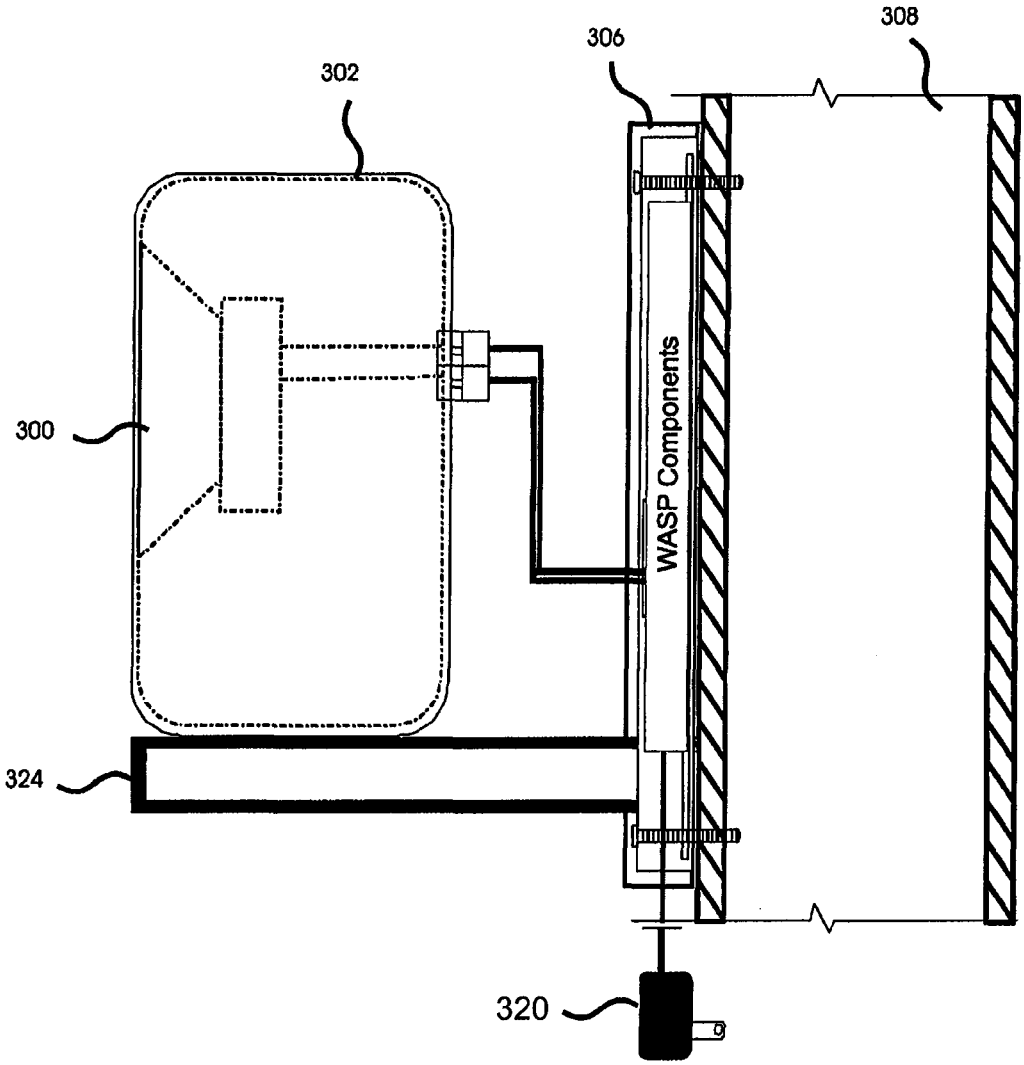

In FIG. 3G, the acoustic speaker housing 302 is mounted by resting it on a shelf 324 attached to and extending horizontally outward from the WASP housing 306. The WASP housing 306 is attachable by screws to a supporting surface 308, which in FIG. 3G is a wall.

Figure 3H:
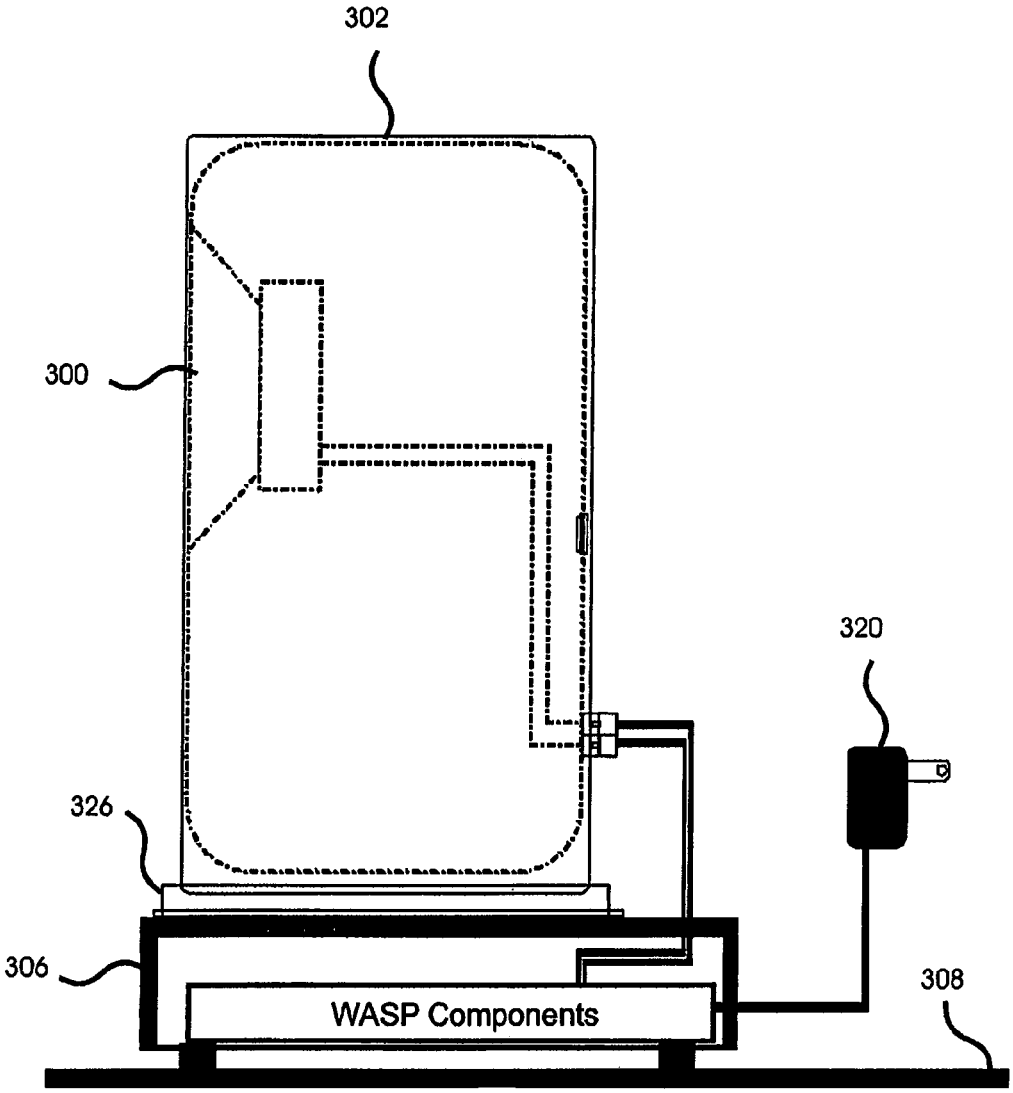

In FIG. 3H, the acoustic speaker housing 302 rests on a base 326, sometimes called a "plinth" that is attached to the top of the WASP housing 306. The WASP housing 306 is supported by resting it on the horizontal surface of the floor 308.

Figure 3I:
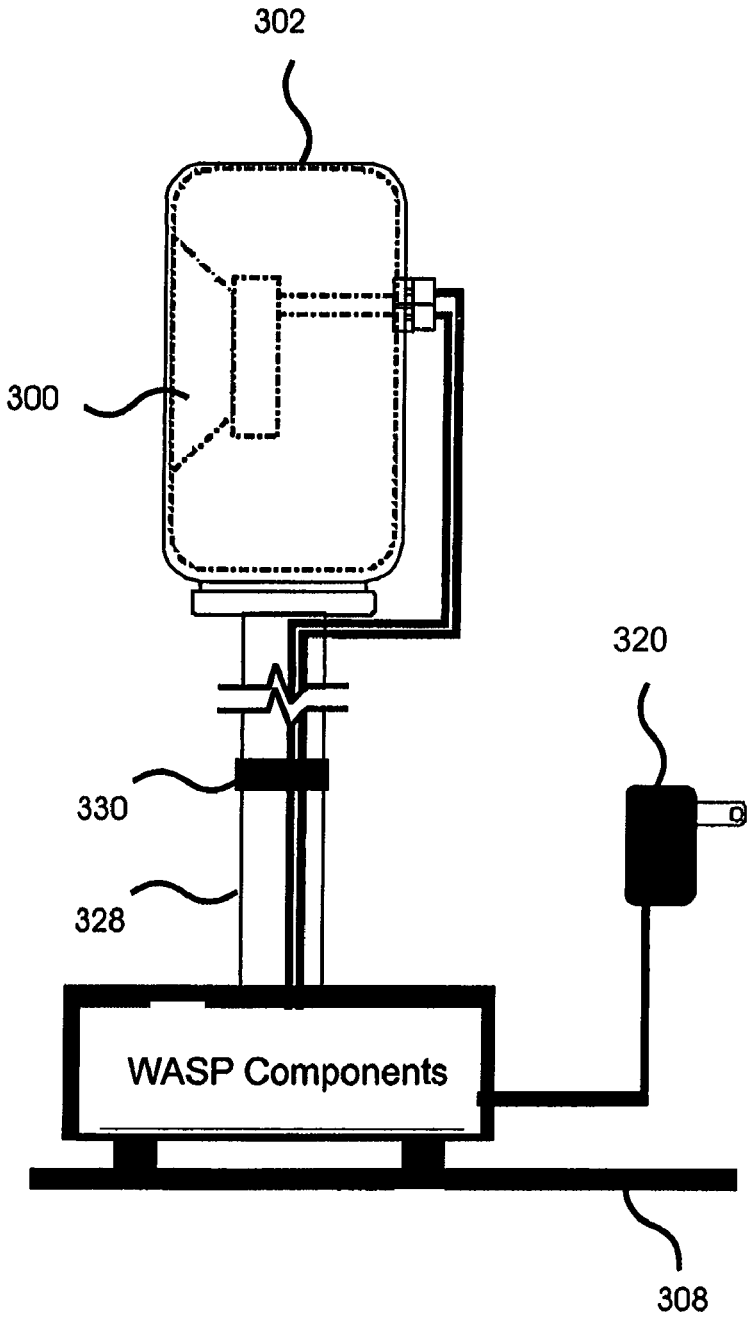

FIG. 3I is similar to FIG. 3H, except that the plinth 326 is replaced by a stand 328 that can be varied in height by loosening a clamping ring 330 and allowing concentric inner and outer parts of the stand 328 to telescope relative to each other, resulting in taller or shorter heights. This allows adjustment of the height of the acoustic speaker housing 302 above the WASP housing 306, and thereby above the floor 308, so as to place the acoustic speaker 300 at a height that will result in optimal sound production according to the design of the speaker and the configuration of the room. In similar embodiments, the stand is of fixed height according to specifications provided by the manufacturer of the speaker.

Figure 3J:
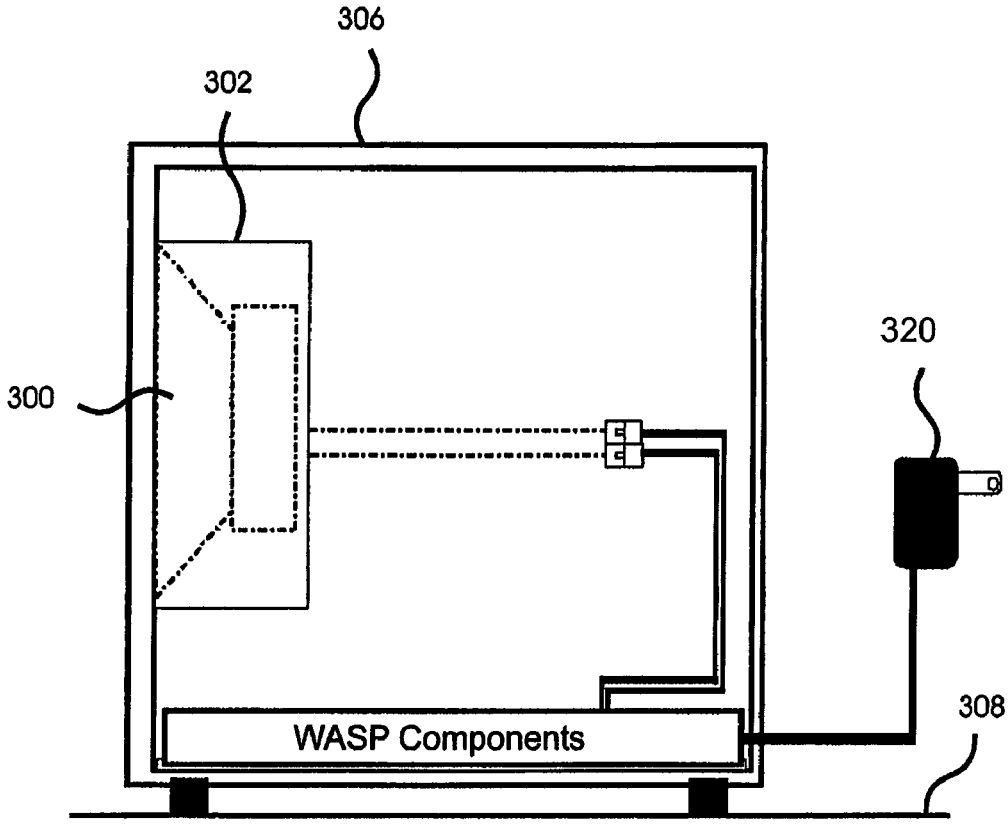

In FIG. 3J, the acoustic speaker housing 302 is mounted inside of the WASP housing 306, and the WASP housing rests on the floor 308.

Figure 4:
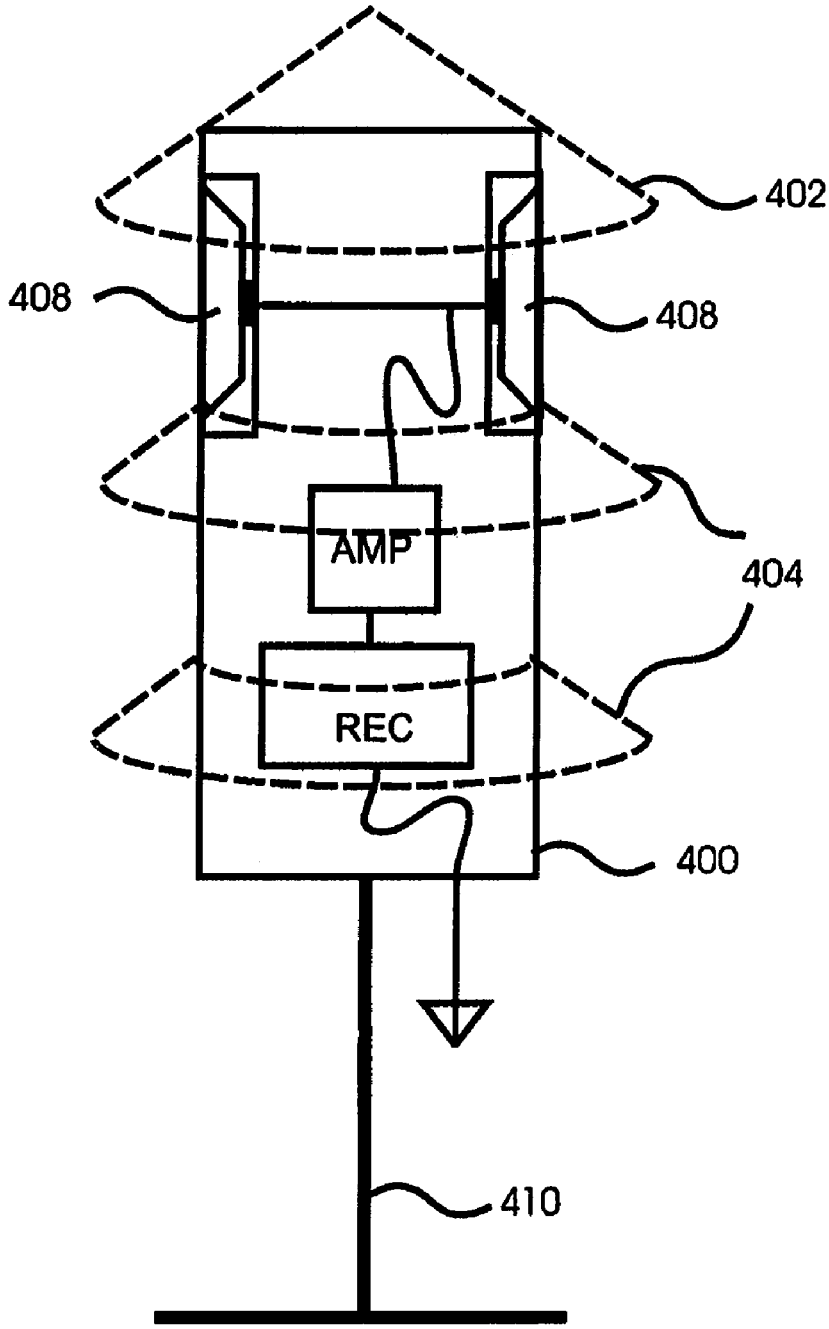
FIG. 4 illustrates a WASP designed for outdoor use, wherein the WASP is supported by a pole projecting upward from the ground, two acoustic speakers are mounted inside of the WASP and the outer structure of the WASP is designed to protect the speakers and other WASP contents from damage by the weather.

FIG. 4 illustrates a preferred embodiment that is designed for use outdoors. The WASP housing 400 includes a conical top 402 and sloping side baffels 404 that allow sound to be emitted from the WASP 400 but cause rain to run off harmlessly and also shield the WASP 400 from direct sunlight. For visual clarity, only two acoustic speakers 406, 408 are shown as mounted inside of the WASP 400. In preferred embodiments three or four acoustic speakers are mounted inside of the WASP 400, so as to project sound laterally in all directions. In general, regardless of mounting and installing strategies, and regardless of whether the WASP is designed for indoor or outdoor use, many embodiments of the WASP include a plurality of acoustic speakers, including for example so-called "woofers" and "tweeters," so as to produce better sound and for other purposes.

In FIG. 4, the WASP 400 is supported from the ground by a stand 410. In preferred embodiments, not shown in FIG. 4, the stand is of variable height and/or is embedded in the ground.

Other modifications and implementations will occur to those skilled in the art without departing from the spirit and the scope of the invention as claimed. Accordingly, the above description is not intended to limit the invention except as indicated in the following claims.

What is claimed is:

1. A speaker mount apparatus, comprising:

a bracket having a wall mounting structure, the wall mounting structure and the bracket configured to capture a first wall board of a wall structure there between;

a first support structure carried by the bracket, the first support structure defining a structure volume configured to fit within a wall volume defined between the first wall board of the wall structure and a second wall board of the wall structure, the second wall board opposing the first wall board;

at least one electronic component carried by the first support structure, the at least one electronic component configured to receive a wireless audio signal from a transmitter and provide an output audio signal to a speaker; and a second support structure carried by the bracket, the second support structure configured to support the speaker.

2. The speaker mount apparatus of claim 1, wherein the at least one electronic component further comprises a converter configured to convert received wireless audio signal to a format compatible with the speaker.

3. The speaker mount apparatus of claim 1, wherein the at least one electronic component further comprises an amplifier configured to amplify the received wireless audio signal.

4. The speaker mount apparatus of claim 1, wherein the at least one electronic component further comprises an adjuster configured to adjust relative amplitudes of the received wireless audio signal within different sound frequency ranges.

5. The speaker mount apparatus of claim 1, wherein the at least one electronic component further comprises a control signal transmitter configured to transmit a control signal to a wireless audio signal source to alter a function of the wireless audio signal source.

6. The speaker mount apparatus of claim 1, wherein the at least one electronic component further comprises a transmitter configured to retransmit the wireless audio signal received by the at least one electronic component, thereby extending the range over which the wireless audio signal can be received.

7. The speaker mount apparatus of claim 1, wherein the at least one electronic component comprises a receiver configured to receive the wireless audio signal from a source external to the speaker mount apparatus.

8. The speaker mount apparatus of claim 1, wherein the at least one electronic component further comprises a power supply configured to supply power to the at least one electronic component via received AC power.

9. The speaker mount apparatus of claim 1, wherein the wall mounting structure comprises a clamp moveably coupled to the bracket, the clamp configured to move between a first position and a second position to secure the bracket to the first wall board.

10. The speaker mount apparatus of claim 1, wherein the first support structure comprises a housing defining a chamber, the chamber configured to contain the at least one electronic component therein.

11. The speaker mount apparatus of claim 1, wherein the first support structure extends along a first direction relative to the bracket and the second support structure extends along a second direction relative to the bracket, the second direction opposing the first direction.

12. The speaker mount apparatus of claim 11, wherein the second support structure is configured to support the speaker external to the first wall board.

13. The speaker mount apparatus of claim 1, wherein the first support structure extends along a first direction relative to the bracket and the second support structure extends along a second direction relative to the bracket, the second direction substantially parallel to the first direction.

14. The speaker mount apparatus of claim 13, wherein the second support structure is configured to support the speaker within the wall volume defined between the first wall board of the wall structure and the second wall board of the wall structure.

15. The speaker mount system of claim 1, wherein the first support structure extends along a first direction relative to the bracket and the second support structure extends along a second direction relative to the bracket, the second direction substantially parallel to the first direction, the second support structure being configured to support the speaker within the wall volume defined between the first wall board of the wall structure and the second wall board of the wall structure.

16. A speaker mount system, comprising:

a speaker having a housing and an electroacoustic transducer carried by the housing; and a speaker mount apparatus, comprising:

a bracket having a wall mounting structure, the wall mounting structure and the bracket configured to capture a first wall board of a wall structure there between;

a first support structure carried by the bracket, the first support structure defining a structure volume configured to fit within a wall volume between the first wall board of the wall structure and a second wall board of the wall structure, the second wall board opposing the first wall board;

at least one electronic component carried by the first support structure, the at least one electronic component configured to receive a wireless audio signal from a transmitter and provide an output audio signal to the speaker; and a second support structure carried by the bracket, the second support structure configured to support the speaker.

17. The speaker mount system of claim 16, wherein the wall mounting structure comprises a clamp moveably coupled to the bracket, the clamp configured to move between a first position and a second position to secure the bracket to the first wall board.

18. The speaker mount system of claim 16, wherein the first support structure comprises a housing defining a chamber, the chamber configured to contain the at least one electronic component therein.

19. The speaker mount system of claim 16, wherein the first support structure extends along a first direction relative to the bracket and the second support structure extends along a second direction relative to the bracket, the second direction opposing the first direction, the second support structure being configured to support the speaker external to the first wall board.

* * * * *